US008794996B1

(12) United States Patent
Matsuoka

(10) Patent No.: US 8,794,996 B1
(45) Date of Patent: Aug. 5, 2014

(54) POWER BRICK WITH A NOTCH

(75) Inventor: Yoshimichi Matsuoka, Cupertino, CA (US)

(73) Assignee: Google Inc., Mountain View, CA (US)

( * ) Notice: Subject to any disclaimer, the term of this patent is extended or adjusted under 35 U.S.C. 154(b) by 68 days.

(21) Appl. No.: 13/472,061

(22) Filed: May 15, 2012

(51) Int. Cl.
*H01R 13/72* (2006.01)

(52) U.S. Cl.
USPC ..... 439/501

(58) Field of Classification Search
USPC ..... 439/501, 528
See application file for complete search history.

(56) References Cited

U.S. PATENT DOCUMENTS

| | | | | |
|---|---|---|---|---|
| 4,973,827 | A | 11/1990 | Nozaki | |
| 4,997,381 | A | 3/1991 | Oh | |
| D338,188 | S | 8/1993 | Lee et al. | |
| 5,507,667 | A * | 4/1996 | Hahn et al. | 439/501 |
| 5,613,863 | A | 3/1997 | Klaus et al. | |
| 5,684,689 | A | 11/1997 | Hahn | |
| 5,720,628 | A * | 2/1998 | Usui et al. | 439/502 |
| 5,819,894 | A * | 10/1998 | Okamoto | 191/12.4 |
| 5,984,224 | A * | 11/1999 | Yang | 242/400.1 |
| 6,086,395 | A | 7/2000 | Lloyd et al. | |
| D428,862 | S | 8/2000 | Queffelec et al. | |
| D456,008 | S | 4/2002 | Kawanobe et al. | |
| 6,386,908 | B2 * | 5/2002 | Kato et al. | 439/528 |
| D478,310 | S | 8/2003 | Andre et al. | |
| D478,546 | S | 8/2003 | Andre et al. | |
| D479,823 | S | 9/2003 | Andre et al. | |
| 6,705,890 | B2 * | 3/2004 | Kitou et al. | 439/528 |
| 6,705,891 | B1 * | 3/2004 | Lin | 439/528 |
| D498,462 | S | 11/2004 | Andre et al. | |
| D519,922 | S | 5/2006 | Andre et al. | |
| 7,077,693 | B1 * | 7/2006 | Symons | 439/501 |
| 7,175,474 | B1 * | 2/2007 | Chang et al. | 439/501 |
| D552,034 | S | 10/2007 | Hobson et al. | |
| D573,946 | S | 7/2008 | Ledbetter et al. | |
| 7,399,199 | B2 * | 7/2008 | Symons | 439/501 |
| 7,467,971 | B2 * | 12/2008 | Lin et al. | 439/501 |
| D587,192 | S | 2/2009 | McGinley et al. | |
| D593,031 | S | 5/2009 | Miyatake et al. | |
| D595,654 | S | 7/2009 | Andre et al. | |
| D599,738 | S | 9/2009 | Amidei et al. | |
| 7,621,765 | B1 | 11/2009 | Wu | |
| D611,415 | S | 3/2010 | Andre et al. | |
| D621,782 | S | 8/2010 | Chang et al. | |
| 7,766,698 | B1 | 8/2010 | De Iuliis et al. | |
| D623,136 | S | 9/2010 | Andre et al. | |
| 7,803,012 | B2 * | 9/2010 | Shen et al. | 439/501 |
| 7,887,341 | B2 * | 2/2011 | Liao | 439/131 |
| 7,911,757 | B2 * | 3/2011 | Hsu et al. | 361/118 |
| D638,357 | S | 5/2011 | Sasada et al. | |
| D639,238 | S | 6/2011 | Serrano | |
| 8,087,946 | B2 | 1/2012 | Namiki et al. | |
| D658,123 | S | 4/2012 | Andre et al. | |
| D662,473 | S | 6/2012 | Andre et al. | |
| 8,215,983 | B2 * | 7/2012 | Obata et al. | 439/528 |
| 8,222,773 | B2 | 7/2012 | De luliis et al. | |
| 8,382,526 | B2 | 2/2013 | Chen et al. | |
| 8,517,761 | B2 * | 8/2013 | Frenkil | 439/501 |

(Continued)

*Primary Examiner* — Ross Gushi
(74) *Attorney, Agent, or Firm* — Lerner, David, Littenberg, Krumholz & Mentlik, LLP

(57) ABSTRACT

An example power adaptor is provided. In one aspect, the power adaptor may include a brick and a cable. The brick may further include a notch with an insert disposed therein. A portion of the cable may be inserted through a narrow portion of the insert and secured within a slot of the insert.

18 Claims, 5 Drawing Sheets

(56) References Cited

U.S. PATENT DOCUMENTS

| | | | | |
|---|---|---|---|---|
| 8,529,287 | B2 * | 9/2013 | Frenkil | 439/501 |
| 2002/0106933 | A1 * | 8/2002 | Lee | 439/501 |
| 2002/0106934 | A1 * | 8/2002 | Bean | 439/501 |
| 2002/0127898 | A1 | 9/2002 | Liu | |
| 2002/0168891 | A1 * | 11/2002 | Kitou et al. | 439/501 |
| 2003/0137810 | A1 * | 7/2003 | Chen | 361/752 |
| 2004/0204177 | A1 | 10/2004 | Pon | |
| 2005/0026495 | A1 * | 2/2005 | Zoller | 439/501 |
| 2009/0117765 | A1 | 5/2009 | Wen et al. | |
| 2010/0015848 | A1 * | 1/2010 | Huang et al. | 439/501 |
| 2010/0068920 | A1 * | 3/2010 | Shen et al. | 439/501 |
| 2010/0139950 | A1 * | 6/2010 | Chen | 174/135 |
| 2010/0261376 | A1 * | 10/2010 | Hwang et al. | 439/501 |
| 2011/0053410 | A1 | 3/2011 | Namiki et al. | |
| 2012/0220162 | A1 * | 8/2012 | Zhou et al. | 439/501 |
| 2012/0322296 | A1 * | 12/2012 | Frenkil | 439/501 |
| 2012/0322297 | A1 * | 12/2012 | Frenkil | 439/501 |
| 2013/0023148 | A1 * | 1/2013 | Yap | 439/501 |

* cited by examiner

POWER BRICK WITH A NOTCH

BACKGROUND

Power adaptors typically include a power brick and a long cable attached thereto. Some power adaptors include a VELCRO® strap wrapped around a portion of the cable, so that the cable may be bundled and secured using the VELCRO® strap. This design, however, can be cumbersome and the cable often gets tangled. Moreover, the noise associated with VELCRO® can be annoying, and the VELCRO® strap may become lost.

Other power adaptors may include cable management hooks which project out from the power brick. This design also suffers certain disadvantages, such as broken hooks, or increased manual manipulation.

BRIEF SUMMARY

One aspect of the disclosure provides a power adaptor, and the power adaptor may include a brick including a plurality of faces. The power adaptor may also include a cable attached to one of the plurality of faces, and a notch formed in one of the plurality of faces of the brick. The notch may include an opening extending along a dimension of the face. The power adaptor may include an insert disposed at least partially within the notch, and the insert may include a narrow portion and a slot, wherein the narrow portion includes an opening width w and the slot includes an opening size d such that w<d. In one example, w may be less than at least one dimension of a cross section of the cable. In another example, w may be less than at least one dimension of a cross section of the cable by approximately 0.2 mm. In another example, d may be greater than at least one dimension of a cross section of the cable. In another example, d may be greater than at least one dimension of a cross section of the cable by approximately 0.2 mm.

According to one aspect of the disclosure, the insert may include a deformable material. In one example, the insert may be formed of a thermoplastic elastomer. According to one aspect, the cable may attach to the brick on the same face in which the notch is formed. In one example, the notch and the insert may have the same shape. In another example, the notch may extend across a smaller dimension of the face. According to one aspect, the notch may be formed on a corner of two adjacent faces such that it extends between the two adjacent faces.

According to one aspect of the disclosure, the narrow portion may include a rectangular shaped opening extending from a first plane including the face and extending towards a second plane including an opposing face. In one example, a cross-sectional shape of the slot may be at least one of circular, elliptical, and polygonal. The brick may be in the shape of a substantially rectangular cuboid.

Another aspect of the disclosure provides a power adaptor, and the power adaptor may include a brick including a plurality of faces. The power adaptor may also include means for coupling a proximal end of a cable to one of the plurality of faces. The power adaptor may also include means for receiving a portion of the cable within a portion of the brick, and the portion of the cable may be spaced distally from the proximal end. The power adaptor may also include means for removably securing the portion of the cable.

Another aspect of the disclosure provides a power adaptor, and the power adaptor may include a substantially rectangular brick including two major opposing faces and a plurality of minor opposing faces positioned between the major faces thereby forming a three-dimensional shape. The power adaptor may also include a cable attached to one of the plurality of minor faces, and a notch formed in the same one of the plurality of faces as the cable. The notch may include an opening extending along a minor dimension of the minor face. The power adaptor may also include a deformable insert, having substantially the same shape as the notch, disposed at least partially within the notch. The insert may include a narrow portion having a rectangular shaped opening extending from a first plane including the face and extending towards a second plane including an opposing face. The insert may also include a slot having a cross-sectional shape that is at least one of circular, elliptical, and polygonal, wherein the narrow portion includes an opening width w and the slot includes an opening size d.

In one example, the insert may be formed of a thermoplastic elastomer. In another example, w may be less than at least one dimension of a cross section of the cable by approximately 0.2 mm. In yet another example, d may be greater than at least one dimension of a cross section of the cable by approximately 0.2 mm.

DETAILED DESCRIPTION

According to aspects of the disclosure, a power adaptor includes a cable coupled to a brick, wherein the brick is adapted to receive a portion of the cable. For example, the brick includes a notch with an insert disposed partially therein, allowing a length of the cable to be wrapped around the brick and a portion of the cable to be secured within the insert. The insert may include a narrow portion and a slot for receiving and securing the cable. The insert may be deformable, and the narrow portion of the insert may be approximately the same size or smaller than the cable. When the cable is inserted through the narrow portion of the insert, the cable is secured within the slot based on the size difference between it and the narrow portion. In some examples, only a portion of the length of the cable may be wrapped around and secured to the brick, while the remaining length of cable may be free to connect to a computer.

Figure 1:
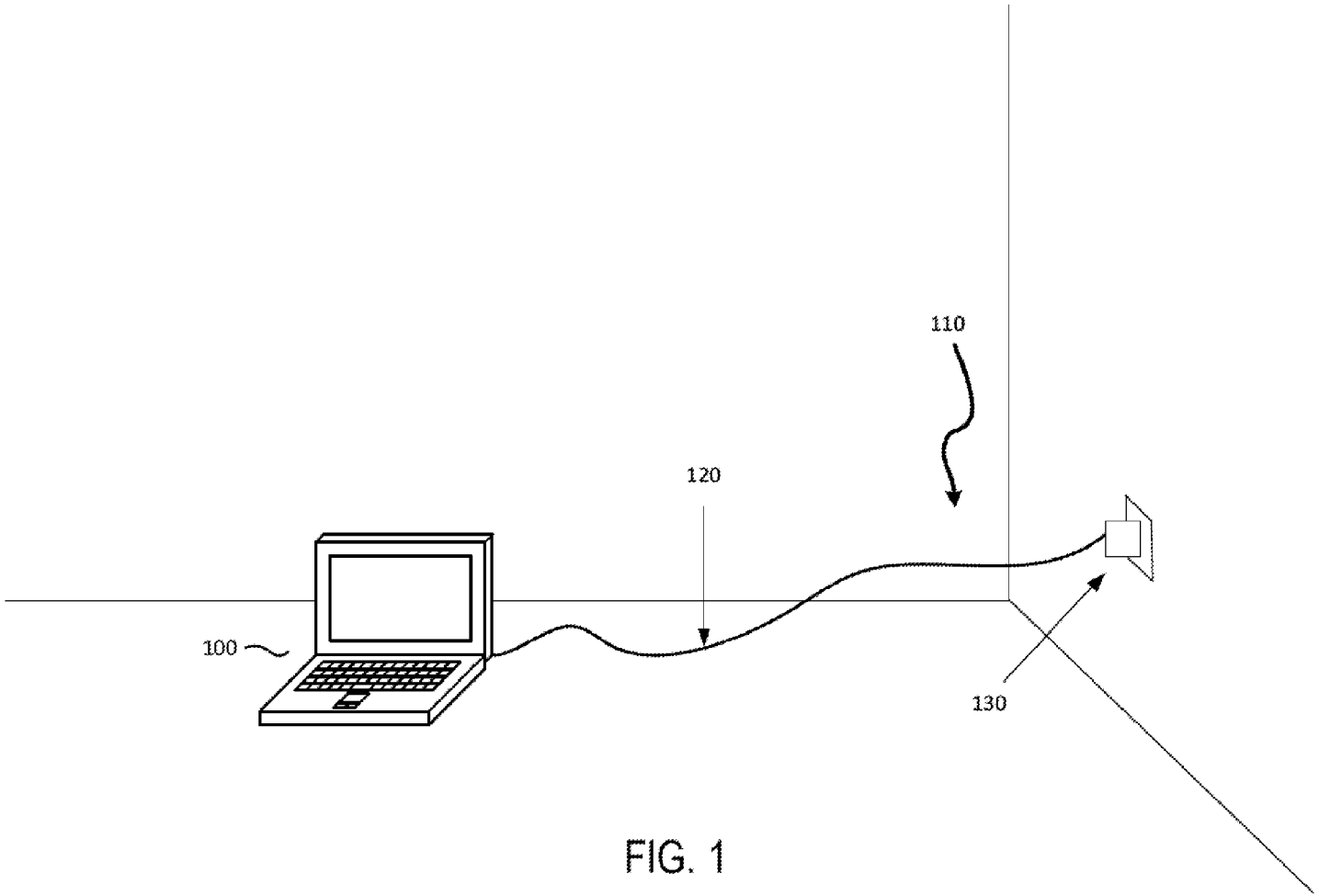
FIG. 1 is an overview of a computer with an example power adaptor connected thereto, according to aspects of the disclosure.

FIG. 1 is an overview of a computer 100 with an example power adaptor 110 connected thereto, according to aspects of the disclosure. In this example, the power adaptor 110 is connected to a computer 100 and is also connected to an electrical outlet on a wall. In this way, power from the electrical outlet may be supplied to the computer 100.

The power adaptor 110 may be connected to an electrical outlet, and power may be provided to the computer 100. Power provided to the computer 100 may charge an internal battery (not shown) of the computer 100, or may alternatively directly power the computer 100, including any components attached thereon or thereto, such as an external hard drive, printer, USB drive, speakers, headphones, or any other component capable of being connected to any of the computing devices mentioned above.

The computer 100 may be any type of computer, such as a laptop computer, personal computer, a mobile computing device, a personal digital assistant (PDA), a mobile phone, a tablet or other handheld computing device. Moreover, the computer 100 may be any other type of computing device, including, but not limited to, a storage medium (e.g., a hard drive), a networking component (e.g., a switch, router, a modem, a server, a host, etc.), or a gaming device (e.g., a console gaming device or a handheld gaming device). The above list is not exhaustive, and many other computing devices not listed may be used with the example power adaptor 110.

The computer 100 may also include a processor (not shown), a memory/storage (not shown), and other components typically present in a computer. For instance, memory/storage may store information accessible by processor, including instructions that may be executed by the processor and data that may be retrieved, manipulated or stored by the processor. The memory/storage may be of any type or any device capable of storing information accessible by the processor, such as a hard-drive, ROM, RAM, CD-ROM, flash memories, write-capable or read-only memories. The processor may comprise any number of well-known processors, such as a CPU. Alternatively, the processor may be a dedicated controller for executing operations, such as an ASIC.

The power adaptor 110 may include a cable 120 and a brick 130. The cable 120 may connect at one end to the computer 100 and may connect at another end to the brick 130. The cable 120 may be of any size or dimension suitable for transmitting AC or DC power from brick 130 to computer 100. For example, the cable 120 may have any length desired to allow connection to a power supply, and in one example may have a length of up to 30 feet. A cross section of cable 120 may be of any shape, such as circular, oval, rectangular, or any other two-dimensional geometric shape. In one example, cable 120 may have a substantially circular cross section with a diameter of up to 1 cm. In another example, cable 120 may have a diameter of approximately 4.0 mm+/−1.0 mm.

Cable 120 may be any type of cable capable of transmitting either AC or DC power to a computer 100. For example, cable 120 may include a conductor layer, such as copper, with an insulation layer formed therearound. In addition to transmitting power, the cable 120 may also include other layers, such as layers to transmit data. In one example, the cable 120 may include a fiber optic portion for transmitting a fiber optic signal. In yet another example, the cable 120 may transmit both power and data over a single transmission medium.

As discussed above, the cable 120 may include a first end that may be connected to the brick 130. In this way, the first end of the cable 120 may be detachably secured to a corresponding interface on the brick 130. In another example, the cable 120 may be integrally formed with the brick 130. The cable 120 may also include a second end that connects to the computer 100, which will be discussed in greater detail below.

The brick 130 may be connected to an electrical outlet at one end and may provide an AC or DC power supply to cable 120 to be delivered to computer 100. Brick 130 may include an exterior housing and may include power management circuitry therein. The housing may be formed of any material suitable for containing electrical circuitry, and in one example may be formed of a polymer, such as a plastic or polycarbonate/acrylonitrite butadiene styrene (PC/ABS). Brick 130 may be formed in any geometric shape, and in one example may be a substantially rectangular cuboid, e.g., a three-dimensional substantially rectangular box. Brick 130 may have a height, length, and a depth of any size or dimension, such as, for example, 6 cm×6 cm×3 cm or 4 cm×4 cm×2 cm. In some implementations, brick 130 may include six faces, with each face having an opposing face. Each of the faces may have a length and a width that matches a length and a width of the opposing face. In one example, brick 130 may include two major faces and four minor faces. The two major faces may be opposed to one another, and may each have a total area larger than each of the remaining four minor faces. Each of the four minor faces may each be opposed to another minor face. In one example, the two major faces may be substantially square and the four minor faces may be substantially rectangular. In one example, the corners formed between faces may form angles, such as right angles. In another example, the corners of the brick 130 may be rounded.

As mentioned above, the brick 130 may include internal power management circuitry. In one example, the brick 130 may include a rectifier for converting an electrical signal from an outlet and delivering the signal to the cable 120. The electrical outlet may be a wall outlet and may provide an 120V alternating current (AC) signal. In this way, the rectifier may convert an AC signal from an outlet to a direct current (DC) voltage to be delivered to the computer 100. In one example, the brick 130 may provide a DC voltage in the range of approximately 10 to 25V. In another example, brick 130 may not include a rectifier, and may provide an AC signal to the computing device. In any of the above examples, brick 130 may include additional circuitry to alter or modify either an AC or DC power signal, such as but not limited to a voltage divider, capacitor, or diodes.

Figure 2:
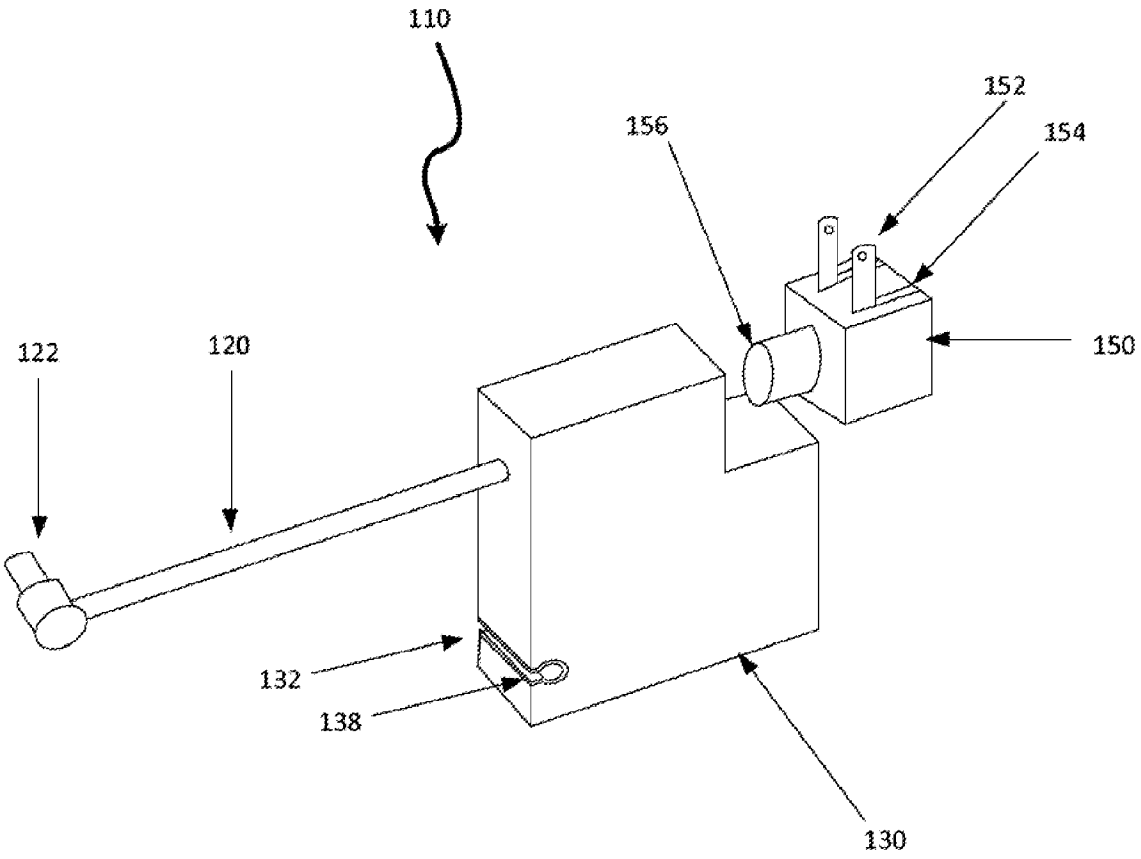
FIG. 2 is a perspective view of an example power adaptor according to aspects of the disclosure

FIG. 2 is a perspective view of the example power adaptor 110. As discussed above, the power adaptor 110 may include the cable 120 and the brick 130. The cable 120 may terminate in a connector 122, which may be connected to a corresponding power jack on computer 100. The connector 122 may be any type of connector capable of delivering AC or DC power and/or data to a computing device. In another example, connector 122 may be compatible with USB, HDMI, VGA, PS2, or any other type of port on a computer.

The brick 130 may also include an outlet attachment 150. The outlet attachment 150 may include one or more prongs 152 for connecting to an electrical outlet. The outlet attachment may further include a plurality of channels 154, allowing the prongs 152 to be rotated and stored within the channels 154. In one example, the outlet attachment 150 is removably attached to the brick 130 via an outlet attachment interface 156, which may connect to a corresponding interface (not shown) on the brick 130. This allows for different types of attachments to be used in conjunction with brick 130 and/or for additional lengths of cable to be attached to the brick. For example, an attachment with a two- or three-prong North American-style plug may be used. In another example, attachments that conform to the outlets of various other countries may be used. In yet another example, the outlet attachment may be compatible with a cigarette lighter adaptor.

The brick 130 may also include a notch 132 with an insert 138 disposed therein. The notch 132 may be formed on a minor face of the brick 130, and may extend along a width of the minor face, extending between adjacent major faces. The notch 132 may be a cutout portion in the housing of brick 130 and may be sized and shaped to receive the insert 138. A length of the cable 120 may be wrapped around the brick 130, and a portion of the cable 120 may be inserted and secured within the insert 138, as will be described in greater detail below.

Figure 3:
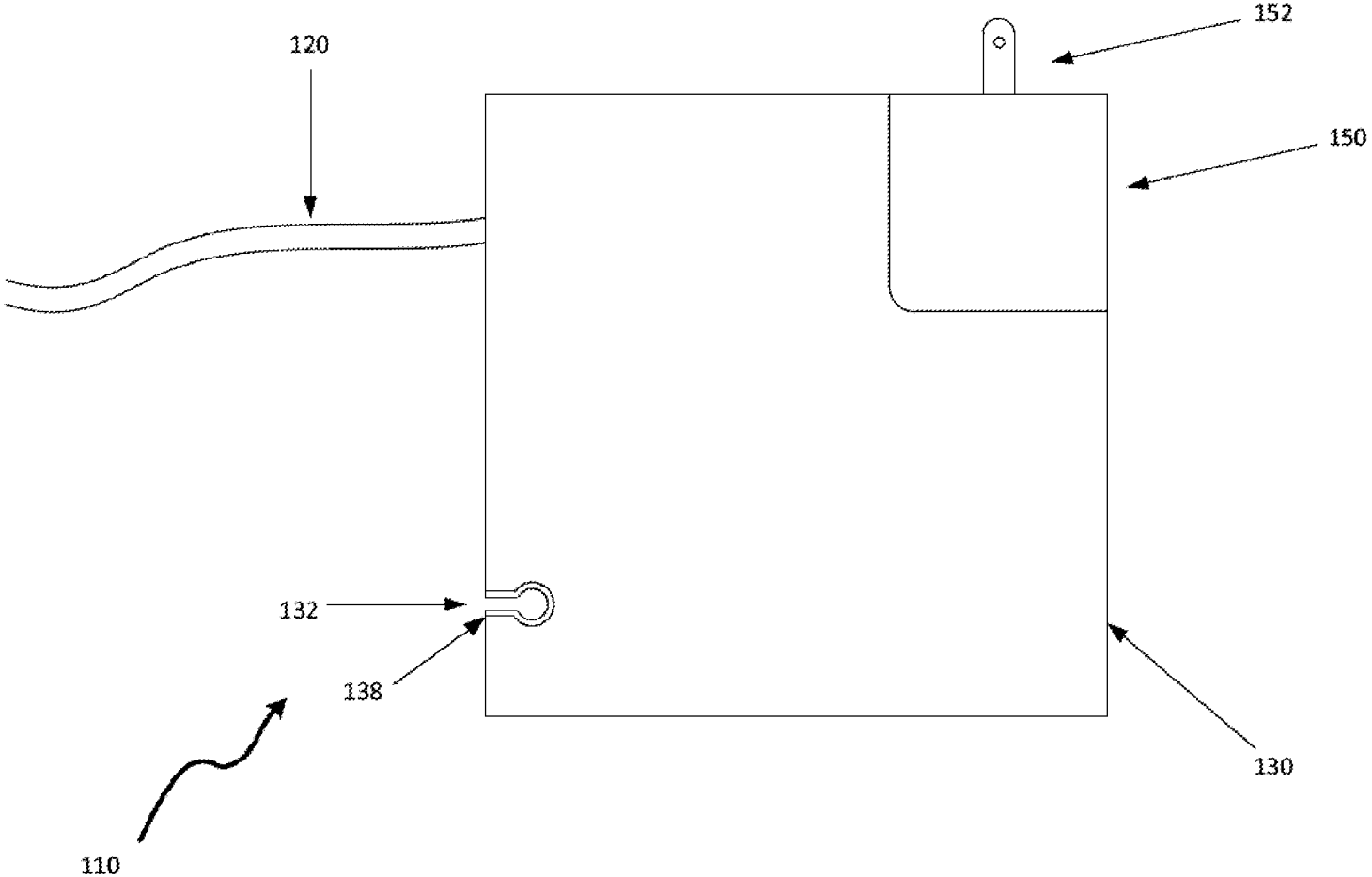
FIG. 3 is a front view of an example brick according to aspects of the disclosure.
Figure 4:
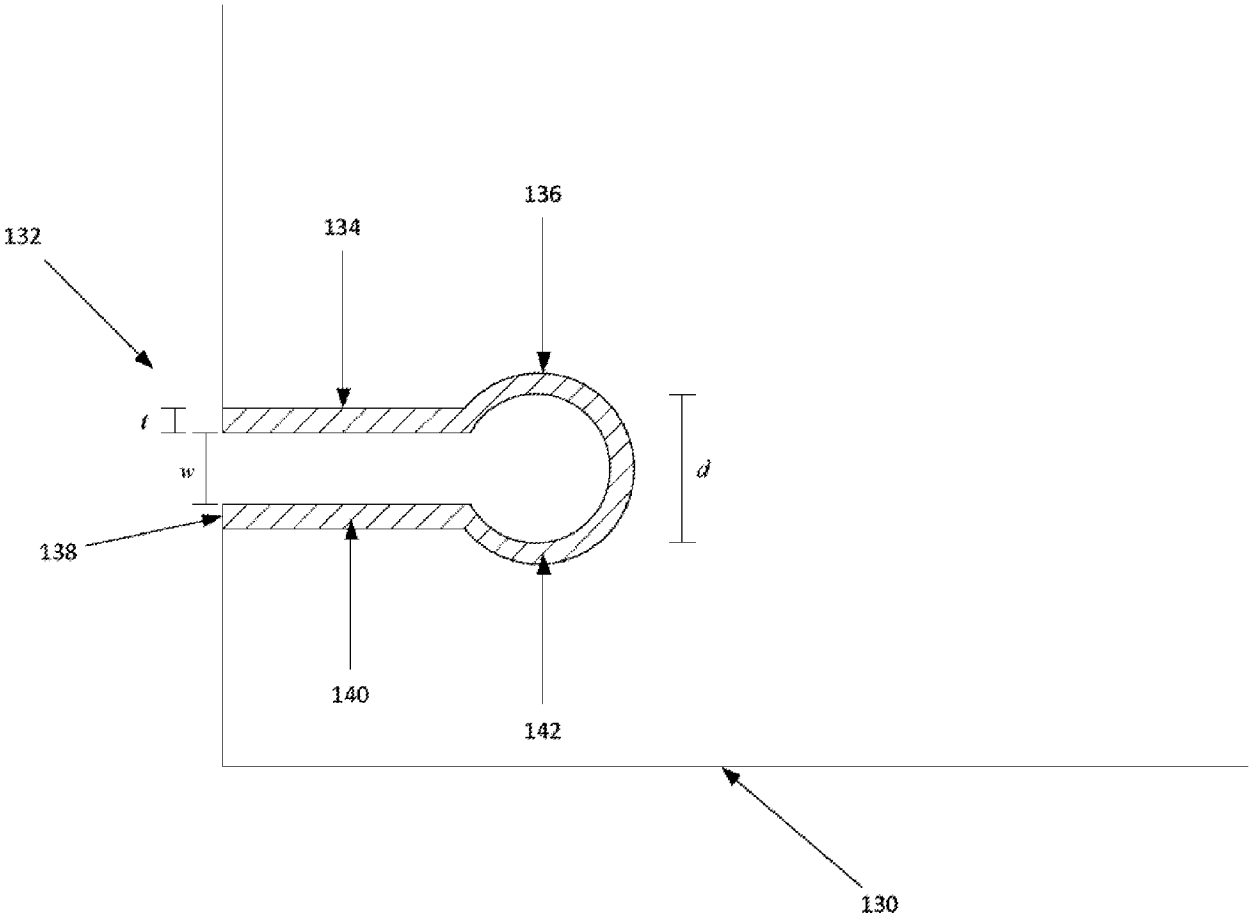
FIG. 4 is an exploded view of a portion of the example brick of FIG. 3.

FIG. 3 is a front view of the brick 130, and FIG. 4 provides an exploded view of the notch 132 with the insert 138 disposed therein. The notch 132 may include a narrow portion 134 and a slot 136. The insert 138 may also include a narrow portion 140 and a slot 142 which may correspond to the narrow portion 134 and the slot 136 of the notch 132. A portion of the cable 120 may be inserted into and secured within the insert 138 by inserting the portion of cable 120 through the narrow portion 140 and into slot 142.

As depicted in FIG. 4, the narrow portion 134 may include two opposing surfaces within the notch 132. The narrow portion 134 may have a depth, such that it extends from a minor face of the brick 130 toward the slot 136. The depth of the narrow portion 134 may be such that the cable 120 can be quickly and easily maneuvered into the slot. For example, the depth may be up to 2 cm, and in one example may be approximately 28 mm. The narrow portion 134 may also have an opening width, e.g., a width between opposing surfaces within notch 132. In one example, the opening width of the narrow portion 134 may be sized to allow the insert 138 to be disposed therein. For example, the opening width of narrow portion 134 may be sized to accommodate a thickness of the insert 138 and to allow the cable 120 to be passed therethrough. In one example, the opening width of narrow portion 134 may be approximately 6.8 mm, e.g., 6.8 mm+/−1.0 mm.

The slot 136 may be of any size or dimension capable of securely receiving the insert 138. As shown in FIG. 4, the slot 136 may be formed as an arc of a circle. An opening size of slot 136 may be sized to accommodate a thickness of insert 138 and to allow cable 120 to be secured therein. In one example, an opening size of slot 136 may be up to 10 mm, and may be approximately 7.2 mm, e.g., 7.2 mm+/−1.0 mm.

According to one example, the insert 138 may be fit within the notch 132. The insert 138 may be sized and shaped to complement the notch 132. For example, the insert 138 may also include a narrow portion 140 and a slot 142 which may correspond to the narrow portion 134 and slot 136 of the notch 132. The insert 138 may be designed to facilitate maneuverability of the cable 120 into and out of the notch 132 via the narrow portion 140, while keeping the cable securely locked within the slot 142 as desired.

The insert 138 may be formed of any type of material. In one example, insert 138 may be formed of a deformable material in order to allow cable 120 to pass through narrow portion 140. Alternatively, only a portion of insert 138 may be deformable, such as either narrow portion 140 or slot 142. In another example, the insert 138 may be formed of a polymer, such as a thermoplastic elastomer. In this way, insert 138 may be formed by injection molding, or any other suitable method of forming a thermoplastic elastomer. Insert may be secured within notch 132 by any type of fixation method, such bonding, adhesion, press-fitting, or the like.

The insert 138 may have a thickness, represented by thickness t in FIG. 4. In one example, thickness t may be have a substantially uniform thickness, and in another example, may be thicker or thinner at certain portions of insert 138. In one example, thickness t may be approximately 1.5 mm, e.g., 1.5 mm+/−0.5 mm. In this way, insert 138 may extend approximately 1.5 mm away from an inner surface of notch 132.

In one implementation, opening width w of the narrow portion 140 of the insert 138 may be approximately the same size or smaller than at least one dimension of the cross section of cable 120. For example, where the cable 120 includes a circular cross section having a diameter, the opening width w may be the same size or slightly smaller than the diameter. In one example, opening width w may be approximately 0.2 mm less than the dimension of the cross section of the cable 120. For example, where cable 120 has a diameter of approximately 4.0 mm, opening width w may be approximately 3.8 mm. In this way, insert 138 may deform slightly upon insertion of the cable 120 into the narrow portion 140, but will still allow the cable 120 to pass through. Once the cable 120 is through the narrow portion 140, it may be secured within the slot 142, for example, by virtue of the size difference between narrow portion 140 and cable 120. Based on this size difference, cable 120 may not freely enter and exit narrow portion 140, but may be removed by a user with minimal effort.

The slot 142 may be of any shape, and in one example may correspond to a cross section of cable 120. For example, in the example where cable 120 has a substantially circular cross section, slot 142 may have a cross-section taken in a plane including a major face in the shape of an arc corresponding to a substantially circular shape.

The slot 142 may have an opening size, represented as opening size d in FIG. 4. Opening size d may be larger than at least one dimension of the cross section of cable 120. For example, referring back to the example above where the cable 120 has a circular cross section, the opening size d of the slot 142 may be greater than a diameter of the cable 120. This may allow the cable 120 to loosely fit within slot 142. According to one example, the opening size d may be up to 10 cm, and may be approximately 0.2 mm larger than one dimension of the cross section of cable 120. For example, if a cross section of cable 120 is a 4 mm diameter, an opening size may be approximately 4.2 mm. In another example, the cable 120 may have a substantially rectangular cross section, including a length and a width. The opening size d may be larger than the length but smaller than the width, or vice versa. Alternatively, the opening size d may be larger than both the length and the width of the rectangular cross section of the cable 120, while opening width w may be larger than the length but smaller than the width, or vice versa. In this example, cable 120 may be inserted through narrow portion 140 and rotated about a central axis of cable 120. Although narrow portion 140 and slot 142 are depicted as having an overall keyhole shape in FIGS. 3 and 4, it is understood that the overall shape may vary based on a cross section and dimensions of cable 120.

While particular examples for the notch 132 and insert 138 have been described above with respect to FIGS. 2-4, many modifications may be made to the notch 132 and insert 138, for example, to accommodate different sizes, shapes, and materials of the cable 120 and the brick 130. For example, although the notch 132 is depicted as being formed on the same minor face as the cable 120, the notch 132 may be formed on any major or minor face of the brick 130. For example, the notch 132 may extend longitudinally along a minor face of the brick 130 such that it extends between opposing minor faces. Alternatively, the notch 132 may be formed at a corner portion of the brick 130 such that the notch 132 extends between a first minor face and an adjacent minor face. Moreover, the cable 120 may be connected to any major or minor face of the brick 130.

Further, the shape of the notch 132 or insert 138 may be modified, for example, based on a shape of the cross-section of the cable 120. For example, although in FIG. 4 a cross-sectional shape of the slot 142 is depicted as an arc of a circle, the cross-section of the slot 142 may be of any geometric shape, such as elliptical, polygonal, etc. For example, the shape of the slot 142 may be substantially similar to the shape of the cross-section of the cable 120, or otherwise complementary. For example, the slot 142 may comprise a long rectangle substantially perpendicular to the narrow portion 140, and may thereby enable a circular cross-sectioned cable 120 to move along a length of the rectangle.

In yet another example, the insert 138 may be shaped differently than the notch 132. For example, the narrow portion 140 of the insert 138 may be of a different overall shape than the narrow portion 134 of the notch 132. For example, the narrow portion 140 of the insert 138 may include a bumpy or grooved surface to prevent the cable 120 from slipping out. Further, inner surfaces of the narrow portion 140 may be angled so as to guide the cable 120 into or out of the slot 136. Similarly, the shape of the slot 142 may be different from the shape of the slot 136. Moreover, the slot 142 of the insert may include a higher friction surface than the slot 136 and or the narrow portion 140 to facilitate retention of the cable 120 in the slot 142.

Figure 5:
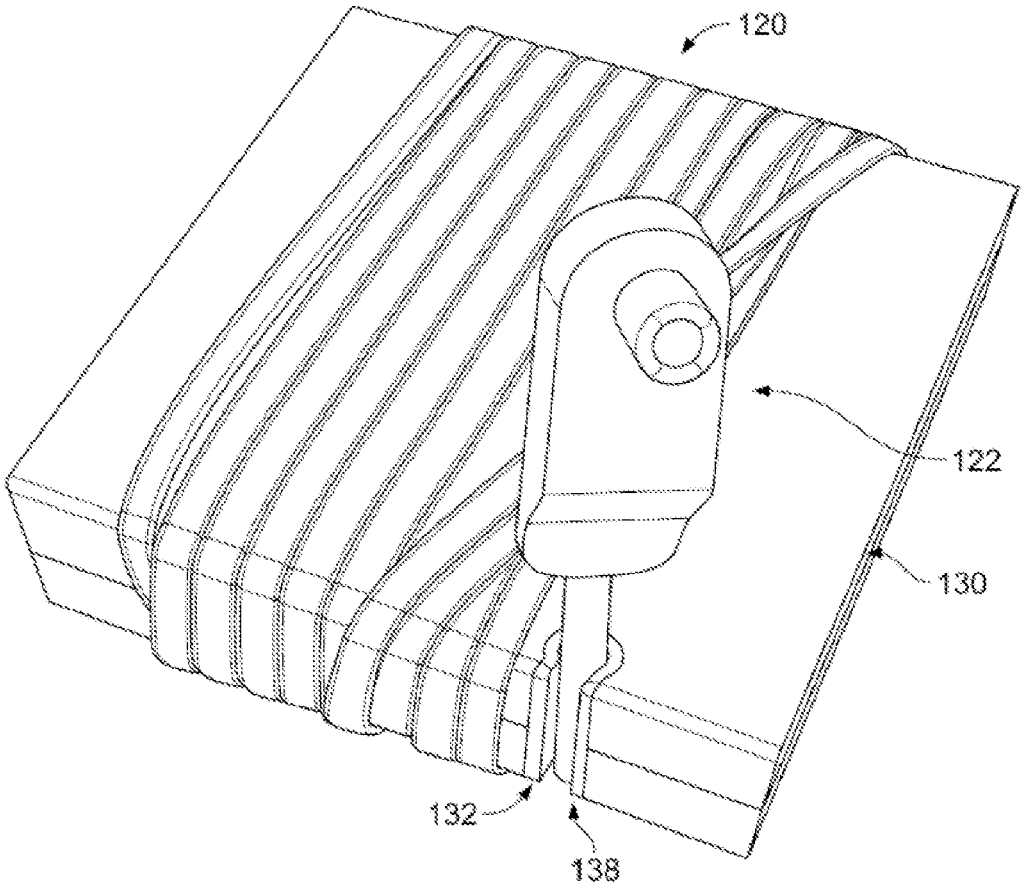
FIG. 5 is a perspective view of the power adaptor showing cable secured within notch.

FIG. 5 is a perspective view of the power adaptor 110 showing the cable 120 secured within the notch 132. In this example, a portion of the cable 120 is wrapped around a housing of brick 130 and a portion of cable 120 is secured within the notch 132. This allows another portion of cable to be freely accessed and plugged into computer 100. Moreover, this enables neat and compact storage of the cable 120, which is particularly useful during travel. Depending on the length of cable 120 and dimensions of brick 130, the number of times cable 120 may be wrapped may vary. A user may wrap cable 120 around brick 130 depending on the length of cable they wish to be freely accessible, or how far they are from the nearest electrical outlet.

As these and other variations and combinations of the features discussed above can be utilized without departing from the invention as defined by the claims, the foregoing description of the embodiments should be taken by way of illustration rather than by way of limitation of the invention as defined by the claims. It will also be understood that the provision of examples of the invention (as well as clauses phrased as "such as," "e.g.", "including" and the like) should not be interpreted as limiting the invention to the specific examples; rather, the examples are intended to illustrate only some of many possible aspects.

The invention claimed is:

1. A power adaptor, comprising:

a brick including a plurality of faces, a cable attached to one of the plurality of faces;

a notch formed in one of the plurality of faces of the brick, the notch comprising an opening extending along a dimension of the face, a narrow portion extending from the opening into the brick, and a slot adjacent to the narrow portion remote from the opening;

an insert disposed at least partially within the notch, the insert including a narrow portion overlying the narrow portion of the notch, and a slot overlying the slot of the notch, wherein the narrow portion of the insert includes an opening width w and the slot of the insert includes an opening size d such that w<d.

2. The power adaptor of claim 1, wherein w is less than at least one dimension of a cross section of the cable.

3. The power adaptor of claim 2, wherein w is less than at least one dimension of a cross section of the cable by approximately 0.2 mm.

4. The power adaptor of claim 1, wherein d is greater than at least one dimension of a cross section of the cable.

5. The power adaptor of claim 4, wherein d is greater than at least one dimension of a cross section of the cable by approximately 0.2 mm.

6. The power adaptor of claim 1, wherein the insert comprises a deformable material.

7. The power adaptor of claim 6, wherein the insert is formed of a thermoplastic elastomer.

8. The power adaptor of claim 1, wherein the cable attaches to the brick on the same face in which the notch is formed.

9. The power adaptor of claim 1, wherein the notch and the insert have the same shape.

10. The power adaptor of claim 1, wherein the notch extends across a smaller dimension of the face.

11. The power adaptor of claim 1, wherein the notch is formed on a corner of two adjacent faces such that it extends between the two adjacent faces.

12. The power adaptor of claim 1, wherein the narrow portion comprises a rectangular shaped opening extending from a first plane including the face and extending towards a second plane including an opposing face.

13. The power adaptor of claim 1, wherein a cross-sectional shape of the slot is at least one of circular, elliptical, and polygonal.

14. The power adaptor of claim 1, wherein the brick is in the shape of a substantially rectangular cuboid.

15. A power adaptor, comprising:

a substantially rectangular brick including two major opposing faces and a plurality of minor opposing faces positioned between the major faces thereby forming a three-dimensional shape;

a cable attached to one of the plurality of minor faces;

a notch formed in the same one of the plurality of faces as the cable, the notch comprising an opening extending along a minor dimension of the minor face, a narrow portion extending from the opening into the brick, and a slot adjacent to the narrow portion remote from the opening;

a deformable insert, having substantially the same shape as the notch, disposed at least partially within the notch, the insert including a narrow portion overlying the narrow portion of the notch, and a slot overlying the slot of the notch, the slot of the insert having a cross-sectional shape that is at least one of circular, elliptical, and polygonal, wherein the narrow portion of the insert includes an opening width w and the slot of the insert includes an opening size d.

16. The power adaptor of claim 15, wherein the insert is formed of a thermoplastic elastomer.

17. The power adaptor of claim 15, wherein w is less than at least one dimension of a cross section of the cable by approximately 0.2 mm.

18. The power adaptor of claim 15, wherein d is greater than at least one dimension of a cross section of the cable by approximately 0.2 mm.

* * * * *

UNITED STATES PATENT AND TRADEMARK OFFICE

CERTIFICATE OF CORRECTION

PATENT NO. : 8,794,996 B1
APPLICATION NO. : 13/472061
DATED : August 5, 2014
INVENTOR(S) : Yoshimichi Matsuoka It is certified that error appears in the above-identified patent and that said Letters Patent is hereby corrected as shown below:

Column 7, lines 53-54, "an opening with w and the slot of the insert includes an opening size d such that w<d." should read --an opening with *w* and the slot of the insert includes an opening size *d* such that *w*<*d*.--

Column 7, line 55, "2. The power adaptor of claim 1, wherein w is less than at" should read --2. The power adaptor of claim 1, wherein *w* is less than at--

Column 7, line 57, "3. The power adaptor of claim 2, wherein w is less than at" should read --3. The power adaptor of claim 2, wherein *w* is less than--

Column 8, lines 47-48, "includes an opening width w and the slot of the insert includes an opening size d." should read --includes an opening width *w* and the slot of the insert includes an opening size *d*.--

Column 8, line 51, "17. The power adaptor of 15, wherein d is greater" should read --17. The power adaptor of 15, wherein *d* is greater--

Column 8, line 54, "18. The power adaptor of claim 15, wherein d is greater" should read --18. The power adaptor of claim 15, wherein *d* is greater--

Signed and Sealed this
Sixteenth Day of August, 2016

Michelle K. Lee

Michelle K. Lee
*Director of the United States Patent and Trademark Office*